US009157435B2

(12) United States Patent
Hannah et al.

(10) Patent No.: US 9,157,435 B2
(45) Date of Patent: Oct. 13, 2015

(54) DOSING MANIFOLD AND SYSTEM

(71) Applicant: Grundfos Holding A/S, Bjerringbro (DK)

(72) Inventors: Gary Ray Hannah, Shawnee, KS (US); Steven Kimon Dimitriadis, Grandview, MO (US); Carlos Javier Uribe, Overland Park, KS (US)

(73) Assignee: Grundfos Pumps Manufacturing Corporation, Fresno, CA (US)

( * ) Notice: Subject to any disclaimer, the term of this patent is extended or adjusted under 35 U.S.C. 154(b) by 303 days.

(21) Appl. No.: 13/631,136

(22) Filed: Sep. 28, 2012

(65) Prior Publication Data

US 2014/0090731 A1 Apr. 3, 2014

(51) Int. Cl.

| | |
|---|---|
| ***F16K 11/20*** | (2006.01) |
| ***F04B 53/22*** | (2006.01) |
| ***F04B 13/00*** | (2006.01) |
| ***F04B 23/00*** | (2006.01) |

(52) U.S. Cl.

CPC ..... *F04B 53/22* (2013.01); *F04B 13/00* (2013.01); *F04B 23/00* (2013.01); *Y10T 137/85978* (2015.04)

(58) Field of Classification Search

CPC ..... F04B 23/00; F04B 13/00; F04B 53/22; Y10T 37/85978

USPC ..... 137/597, 861, 550, 884, 565.01, 137/565.11, 565.12, 565.26, 594

See application file for complete search history.

(56) References Cited

U.S. PATENT DOCUMENTS

| | | | | |
|---|---|---|---|---|
| 4,402,331 | A * | 9/1983 | Taldo et al. | 134/58 R |
| 6,000,427 | A * | 12/1999 | Hutton | 137/597 |
| 7,270,046 | B2 * | 9/2007 | Stephenson et al. | 91/454 |
| 7,905,248 | B2 * | 3/2011 | Yoshida et al. | 137/550 |
| 2003/0098079 | A1 * | 5/2003 | de Silva et al. | 137/884 |
| 2009/0035872 | A1 * | 2/2009 | Feldstein | 436/164 |
| 2011/0067773 | A1 * | 3/2011 | Ambrose | 137/861 |
| 2011/0285125 | A1 * | 11/2011 | Itafuji et al. | 285/122.1 |
| 2013/0081718 | A1 * | 4/2013 | Ubidia | 137/565.01 |

* cited by examiner

*Primary Examiner* — Jessica Cahill

(74) *Attorney, Agent, or Firm* — Jay J. Hoette; The Small Patent Law Group LLC

(57) ABSTRACT

A dosing system for delivering a dosing fluid includes a dosing manifold having a front panel and a rear panel with a plurality of channels and a plurality of inlet and outlet ports in fluid communication with corresponding channels. The front panel holds a plurality of flow control devices in fluid communication with corresponding channels to control the flow of the dosing fluid in the channels. A dosing pump is in fluid communication with the dosing manifold and is configured to pump the dosing fluid through the dosing manifold.

31 Claims, 7 Drawing Sheets

DOSING MANIFOLD AND SYSTEM

BACKGROUND OF THE INVENTION

The subject matter herein relates generally to dosing systems.

Dosing systems are in use in a wide variety of fields. The dosing systems use a metering pump to accurately deliver small doses of dosing fluids, such as liquid chemicals, into specific processes.

A typical dosing system uses a skid to mount metering pumps, a controller, individual piping connecting pressure relief valves, isolation valves, pressure gauges, back pressure valves among other devices. Current systems use standard pipe and fittings manually fitted together to connect the pumps, controls and valves. The assembly time for all of the components is high and may require a skilled installer. The pipe and fitting connections are potential leak points. The piping and fitting connections can be stressed and break. Additionally, a typical system size is approximately 2 feet wide by 3 feet tall and 2 feet deep. Such skids occupy valuable floor space in the plant or building where the dosing system is used.

A need remains for a dosing system that overcomes these and other problems.

BRIEF DESCRIPTION OF THE INVENTION

In one embodiment, a dosing system is provided for delivering a dosing fluid. The dosing system includes a dosing manifold having a front panel and a rear panel coupled together. The rear panel has a plurality of channels and a plurality of exterior inlet and outlet ports. The inlet and outlet ports are in fluid communication with corresponding channels that receive the dosing fluid through corresponding inlet ports and deliver the dosing fluid to corresponding outlet ports. The front panel holds a plurality of flow control devices in fluid communication with corresponding channels to control the flow of the dosing fluid in the channels. A dosing pump is in fluid communication with the dosing manifold and is configured to pump the dosing fluid through the dosing manifold.

Optionally, the front panel may include an inner wall and an outer wall opposite the inner wall and the rear panel may include an inner wall and an outer wall opposite the inner wall, where the inner wall of the front panel faces the inner wall of the rear panel and the inner wall of the front panel defines portions of the channels. At least some of the front panel may be clear to allow portions of one or more of the channels to be visible through the front panel. At least some of the flow control devices may extend into the channels. The front panel may be sealed to the rear panel to seal the channels.

Optionally, the inlet and outlet ports may include standard piping connections configured to be attached to pipes of a piping system. The dosing pump may be connected to at least one outlet port and at least one inlet port. The dosing pump may be mounted to the dosing manifold.

Optionally, the dosing manifold may include a suction side and a pressure side. The suction may include at least one of the inlet ports, at least one of the outlet ports and at least one channel and the pressure side may include at least one of the inlet ports, at least one of the outlet ports, and at least one channel. The dosing pump may be connected between the outlet port of the suction side and the inlet port of the pressure side. The flow control devices may include a pressure relief valve connecting a corresponding channel of the pressure side with a corresponding channel of the suction side. The flow control devices may include a strainer in a corresponding channel of the suction side. The flow control devices may include a pressure gauge measuring a pressure of the dosing fluid in the pressure side. The flow control devices may include a flow indicator in the pressure side. The flow control devices may include isolation valves mounted proximate to corresponding inlet or outlet ports. The isolation valves may allow or restrict flow between the channel and the corresponding inlet or outlet port.

In another embodiment, a dosing manifold is provided for delivering a dosing fluid that includes a rear panel and a front panel. The rear panel has a plurality of channels and a plurality of exterior inlet and outlet ports. The inlet and outlet ports are in fluid communication with corresponding channels that receive the dosing fluid through corresponding inlet ports and that deliver the dosing fluid to corresponding outlet ports. The front panel holds a plurality of flow control devices that are in fluid communication with corresponding channels to control the flow of the dosing fluid in the channels.

In a further embodiment, a dosing system for delivering a dosing fluid is provided including a dosing manifold having a front panel and a rear panel coupled together. The rear panel has a plurality of channels and a plurality of exterior inlet and outlet ports in fluid communication with corresponding channels. The channels receive the dosing fluid through corresponding inlet ports and deliver the dosing fluid to corresponding outlet ports. The front panel holds a plurality of flow control devices in fluid communication with corresponding channels to control the flow of the dosing fluid in the channels. At least one of the front panel and the rear panel define a volute in fluid communication with at least one channel. A dosing pump is coupled to the dosing manifold.

DETAILED DESCRIPTION OF THE INVENTION

Figure 1:
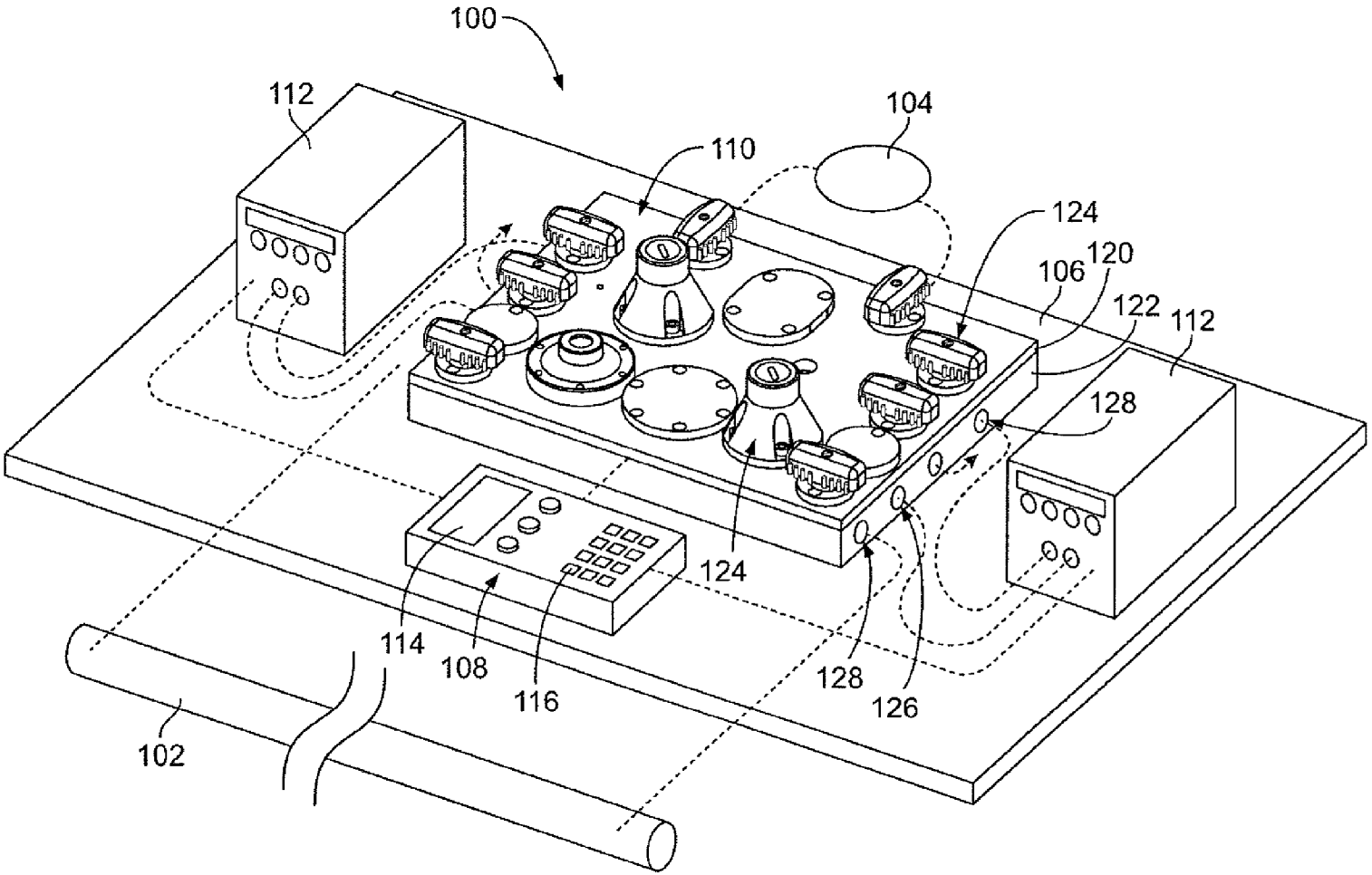
FIG. 1 illustrates a dosing system including a dosing manifold in accordance with an exemplary embodiment.

FIG. 1 illustrates a dosing system 100 formed in accordance with an exemplary embodiment. The dosing system 100 is used to deliver a dosing fluid to a base fluid. A predetermined amount of the dosing fluid is delivered to the base fluid by the dosing system 100. Any type of base fluid may be used depending on the particular embodiment and application. For example, the base fluid may be water or may be another fluid. The base fluid may be contained in a base piping system 102. Alternatively, the base fluid may be held at another receptacle. The dosing fluid may be delivered to the base fluid by piping or tubing (not shown) that connects to the base piping system 102. The dosing fluid is supplied from a dosing fluid supply 104. The dosing fluid may be supplied from the dosing fluid supply 104 by piping or tubing (not shown).

The dosing system 100 includes a skid or housing 106 that holds the other components of the dosing system 100. The dosing system 100 includes a control system 108 for controlling the dosing system 100. The control system 108 is supported by the housing 106. The dosing system 100 includes a dosing manifold 110 that receives the dosing fluid from the dosing fluid supply 104 and directs the dosing fluid to the base piping system 102. The dosing system 100 includes one or more dosing pumps 112 used to pressurize the dosing fluid and transfer the dosing fluid through the dosing manifold 110. Any types of dosing pumps may be used, such as positive displacement pumps, diaphragm pumps, or other types of pumps. In an exemplary embodiment, two dosing pumps 112 are used, such as to allow the dosing system 100 to be continuously used while one of the dosing pumps 112 is brought offline for maintenance or repair or is used as a backup dosing pump.

The dosing manifold 110 is fluidly coupled to the dosing fluid supply 104 by piping or tubing (not shown). The dosing manifold 110 is fluidly coupled to the base piping system 102 by piping or tubing (not shown). In alternative embodiments, the dosing manifold 110 may be directly coupled to the base piping system 102 and/or the dosing fluid supply 104 without the use of piping or tubing. The dosing manifold 110 is fluidly coupled to the dosing pumps 112 by piping or tubing (not shown). In an alternative embodiment, the dosing pumps 112 may be directly connected to the dosing manifold 110 such that a direct fluid path is created between the dosing manifold 110 and the dosing pumps 112 without the use of piping or tubing.

The control system 108 is electrically connected to the dosing pumps 112, such as by a wired connection or a wireless connection. The control system 108 may control the operation of the dosing pumps 112. The control system 108 may monitor the operation of the dosing pumps 112. The control system 108 may be electrically connected to the dosing manifold 110. For example, the control system 108 may be electrically connected to one or more sensors or valves of the dosing manifold 110 to monitor and/or control the sensors and/or valves of the dosing manifold 110. The electrical connection between the control system 108 and the dosing manifold 110 may be wired or wireless. In an exemplary embodiment, the control system 108 includes a display 114 and one or more inputs 116, such as knobs or buttons for controlling the control system 108. Optionally, the control system 108 may communicate with other electronic devices, such as a central monitoring station or computer remote from the dosing system 100. The communication with such central monitoring station may be wired or wireless.

The dosing manifold 110 includes one or more flow paths therethrough that direct the dosing fluid from the dosing fluid supply 104 to the base piping system 102. The dosing manifold 110 includes a front panel 120 and a rear panel 122 that is coupled to the front panel 120. The front and rear panels 120, 122 may be coupled by a variety of means, such as fasteners, sonic welding, chemical bonding, gluing, and the like, and the attachment may be permanent or may be separable. The front and rear panels 120, 122 may be coupled seamlessly.

The front panel 120 holds a plurality of flow control devices 124 that control the flow of the dosing fluid within the dosing manifold 110. The rear panel 122 defines the flow paths. The rear panel 122 includes a plurality of inlet ports 126 and outlet ports 128 along an exterior of the rear panel 122. The inlet and outlet ports 126, 128 may be connected to piping or tubing that connect to the dosing fluid supply 104, the base piping system 102 and/or the dosing pumps 112.

Figure 2:
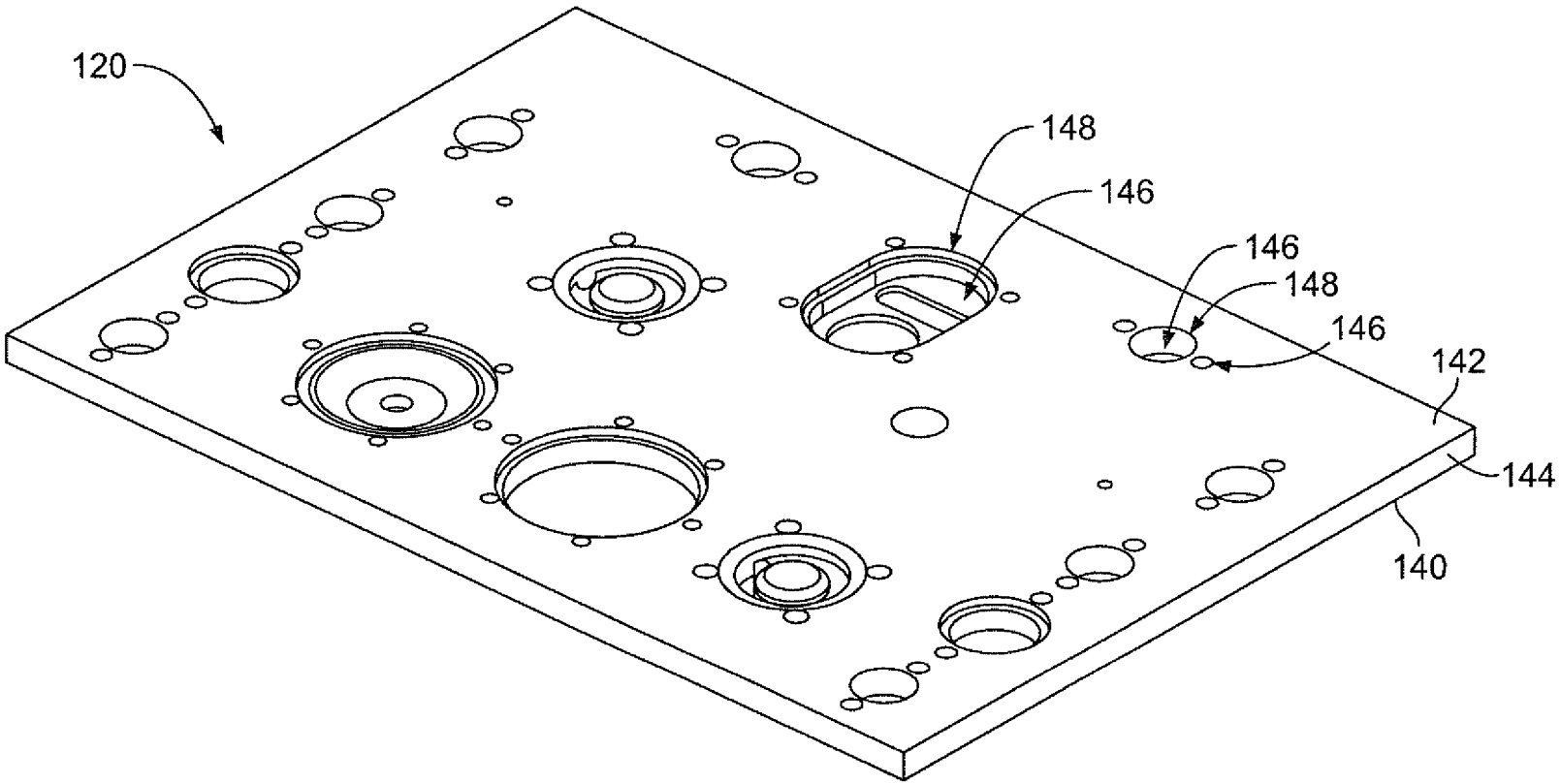
FIG. 2 is a front perspective view of a front panel of the dosing manifold in accordance with an exemplary embodiment.

FIG. 2 is a front perspective view of the front panel 120 formed in accordance with an exemplary embodiment. The front panel 120 includes an inner wall 140 and an outer wall 142 opposite the inner wall 140. The outer wall 142 defines an exterior of the dosing manifold (shown in FIG. 1). The inner wall 140 faces and is configured to be sealed to the rear panel 122 (shown in FIG. 1). In an exemplary embodiment, the front panel 120 is generally planar. However, in alternative embodiments, the front panel 120 may be nonplanar. In an exemplary embodiment, the front panel 120 is rectangular in shape. However, in alternative embodiments, the front panel 120 may have other shapes. The front panel 120 includes edges 144 along the sides of the front panel 120.

The front panel 120 includes a plurality of openings 146 extending therethrough between the inner and outer walls 140, 142. The openings 146 are configured to receive flow control devices 124 (shown in FIG. 1) and/or mounting hardware of the flow control devices 124. The front panel 120 includes device seats 148 within and/or around the openings 146. The device seats 148 receive the flow control devices 124. The flow control devices 124 may be sealed against the device seats 148. Different sized and orientated openings and device seats 146, 148 are provided to interface with different types of flow control devices 124. Any number of openings 146 may be provided depending on the particular application.

In an exemplary embodiment, the front panel 120 is manufactured from a synthetic material, such as a plastic material. The openings 146 may be machined into the front panel 120, may be molded into the front panel 120, or may be formed by other processes. Optionally, at least some of the front panel 120 may be clear or see-through to allow portions of the dosing manifold 110 to be visible through the front panel 120. For example, portions of the flow paths through the dosing manifold 110 may be visible through the front panel 120. Optionally, the entire front panel 120 may be clear or see-through. The front panel 120 may be transparent or semi-transparent. The front panel 120 may be translucent.

Figure 3:
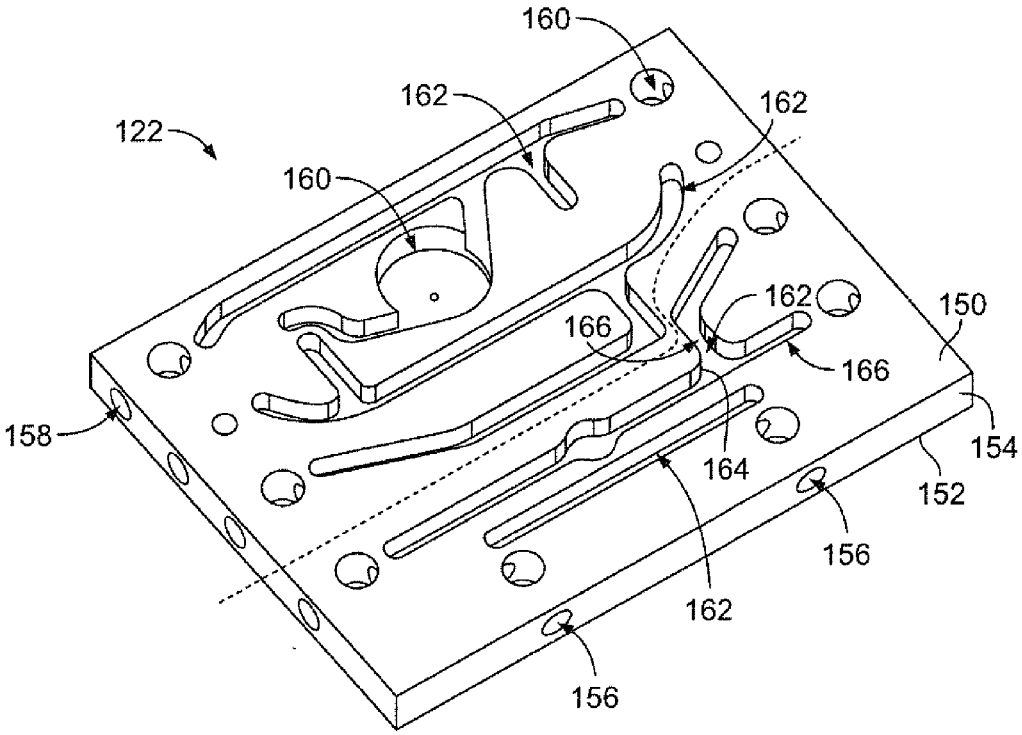
FIG. 3 is a front perspective view of a rear panel of the dosing manifold in accordance with an exemplary embodiment.
Figure 4:
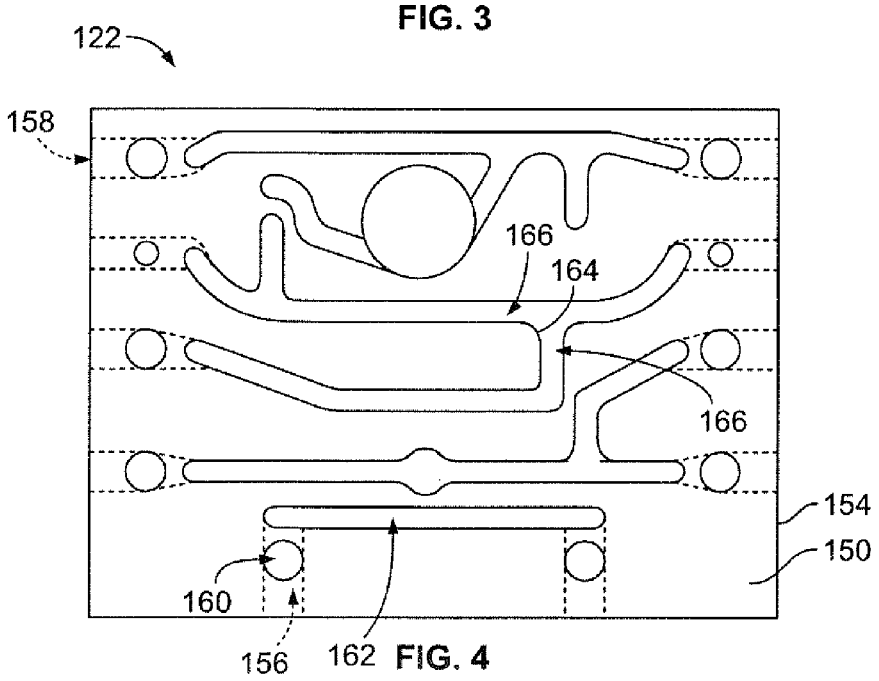
FIG. 4 is a front view of the rear panel.

FIG. 3 is a front perspective view of the rear panel 122. FIG. 4 is a front view of the rear panel 122. In an exemplary embodiment, the rear panel 122 defines the flow paths through the dosing manifold 110 (shown in FIG. 1). The rear panel 122 defines flow paths between various flow control devices 124 (shown in FIG. 1) and ports 126, 128.

The rear panel 122 includes an inner wall 150 and an outer wall 152 opposite the inner wall 150. The outer wall 152 defines an exterior of the dosing manifold 110. The front panel 120 (show in FIG. 2) is configured to be coupled to the inner wall 150. The front panel 120 may be joined to the rear panel 122 by any method or process. In an exemplary embodiment, the front panel 120 is sealed to the rear panel 122 to seal the flow paths through the dosing manifold 110. The front panel 120 may define portions of the flow paths by closing off open sides of the flow paths. Optionally, gaskets or o-rings may be provided between the front panel 120 and the rear panel 122. The front panel 120 may be secured to the rear panel 122 by welding, such as sonic welding, by bonding, such as by solvent bonding, or by using other processes.

The rear panel 122 includes edges 154 along the sides of the rear panel 122. Optionally, the edges 154 may be perpendicular to one another to define a rectangular shape for the rear panel 122. The rear panel 122 may have other shapes in alternative embodiments. Optionally, the rear panel 122 may be generally planar.

The rear panel 122 includes a plurality of inlet ports 156 and a plurality of outlet ports 158 along the exterior edges 154. Optionally, the inlet and outlet ports 156, 158 may define the inlet and outlet ports 126, 128 of the dosing manifold 110. Any number of inlet and outlet ports 156, 158 may be provided depending on the particular application. Optionally, the rear panel may include a single inlet port 156 and a single outlet port 158. The inlet and outlet ports 156, 158 may extend through the inner wall 140 or the outer wall 142 in alternative embodiments. The rear panel 122 receives dosing fluid through the inlet ports 156. The dosing fluid is dispensed from the rear panel 122 through the outlet ports 158. The inlet and outlet ports 156, 158 may be standard piping connections configured to be attached pipes of a piping system. For example, the inlet and outlet ports 156, 158 may define NPT fittings.

The rear panel 122 includes a plurality of openings 160 extending at least partially therethrough. The openings 160 are open through the inner wall 150. In an exemplary embodiment, the openings 160 do not extend through the outer wall 152. The openings 160 are configured to receive portions of the flow control devices 124 (shown in FIG. 1), which are mounted to the front panel 120 and which are loaded into the openings 160 after the front panel 120 is coupled to the rear panel 122. In an exemplary embodiment, the opening 160 are in fluid communication with corresponding inlet ports 156 or outlet ports 158.

The rear panel 122 includes a plurality of channels 162 extending along the inner wall 140. In an exemplary embodiment, the channels 162 are open at the inner wall 150. Alternatively, the channels 162 may generally be enclosed by the rear panel 122. The channels 162 define flow paths through the dosing manifold 110. Any number of channels 162 may be provided. The channels 162 may be provided at predetermined locations depending on the particular application and location of the corresponding inlet and outlet ports 156, 158, openings 160 and flow control devices 124.

In an exemplary embodiment, the rear panel 122 is manufactured from a synthetic material, such as a plastic material. The channels 162 may be machined into the rear panel 122. Alternatively, the channels 162 may be molded into the rear panel 122 during forming of the rear panel 122 or may be formed by other processes. In an exemplary embodiment, the channels 162 include curved transition walls 164 to transition between different segments 166 of the channels 162. The smooth, curved transition walls 164 minimize flow restriction and reduce the chance of clogging within the channels 162. The smooth, curved transition walls 164 allow the segments 166 to be more easily swept or cleaned out if clogging were to occur by allowing a tool to more easily sweep between segments 166.

Figure 5:
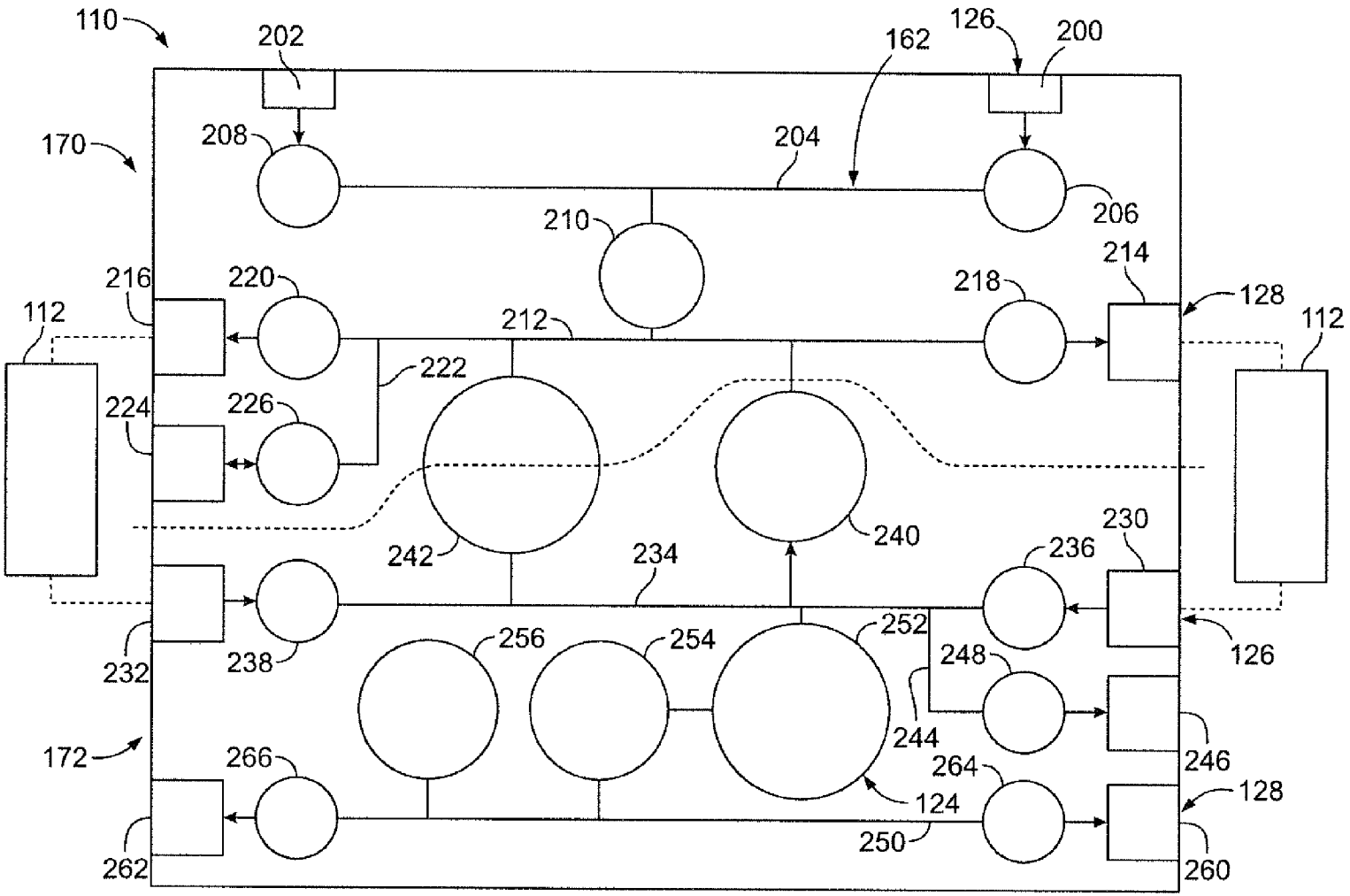
FIG. 5 is a schematic diagram of the dosing manifold.

FIG. 5 is a schematic diagram of the dosing manifold 110 in accordance with an exemplary embodiment. Exemplary embodiments of the inlet ports 126 and outlet ports 128 are represented in FIG. 5 and will be described in further detail below. Exemplary embodiments of the flow control devices 124 are represented in FIG. 5 and will be described in further detail below.

In an exemplary embodiment, the dosing manifold 110 includes a suction side 170 and a pressure side 172. The suction side 170 is upstream of the dosing pumps 112 and the pressure side 172 is downstream of the dosing pumps 112. The dosing fluid is transferred through the suction side 170 and the pressure side 172 by the dosing pumps 112. The dosing fluid in the pressure side 172 is pressurized and fed by the dosing pumps 112 (shown in FIG. 1). The dosing fluid is pulled through the suction side 170 by the dosing pumps 112.

In an exemplary embodiment, the dosing manifold 110 is a dual or redundant system wherein the dosing manifold 110 includes multiple inlets and multiple outlets from the various flow paths to allow part of the system to be shut down, such as for maintenance, while other parts of the system continue to operate and/or to operate the system at varying capacities, such as where part of the system is shut down during times of low use while all of the system is up and running during times of high use.

The dosing manifold 110 includes a first fluid supply inlet port 200 and a second fluid supply inlet port 202. The first and second fluid supply inlet ports 200, 202 are in fluid communication with a first suction line 204. The first suction line 204 may be defined by one of the channels 162 (shown in FIGS. 3-4). Isolation valves 206, 208 are provided in the first suction line 204, such as proximate to the inlet ports 200, 202. The isolation valves 206, 208 may be opened and closed to allow and restrict fluid flow between the first suction line 204 and the inlet ports 200, 202, respectively. The isolation valves 206, 208 are exemplary flow control devices of the dosing manifold 110.

In an exemplary embodiment, the dosing manifold 110 includes a strainer 210 in the suction side 170 downstream of the inlet ports 200, 202. The dosing fluid is forced through the strainer 210 to clear contaminates from dosing fluid. The strainer 210 is an exemplary embodiment of a flow control device. The strainer 210 is positioned between a first suction line 204 and a second suction line 212. The second suction line 212 is defined by one of the channels 162.

The dosing manifold 110 includes a first pump outlet port 214 and a second pump outlet port 216, through which the dosing fluid is discharged from the dosing manifold 110 to the first and second dosing pumps 112. Piping or tubing (not shown) may be connected to the outlet ports 214, 216 to deliver the dosing fluid from the dosing manifold 110 to the dosing pumps 112. In an exemplary embodiment, isolation valves 218, 220 are provided in the second suction line 212 to isolate the second suction line 212 from the outlet ports 214, 216. The isolation valves 218, 220 allow and restrict flow to the outlet ports 214, 216. The isolation valves 218, 220 are exemplary flow control devices of the dosing manifold 110.

In an exemplary embodiment, the dosing manifold 110 includes a bypass line 222 in fluid communication with the second suction line 212. The bypass line 222 is defined by a corresponding channel 162. The bypass line 222 extends to a calibration outlet port 224. Piping or tubing may be connected to the calibration outlet port 224 that goes to a calibration device for calibrating the dosing manifold 110. In an exemplary embodiment, the dosing manifold 110 includes an isolation valve 226 in the bypass line 222. The isolation valve 226 defines a flow control device. The isolation valve 226 allows or restricts fluid flow to the calibration outlet port 224.

The pressure side 172 of the dosing manifold 110 includes a first pump inlet port 230 and a second pump inlet port 232. The first and second pump inlet ports 230, 232 are in fluid communication with piping or tubing (not shown) extending from the dosing pumps 112. The dosing pumps 112 supply the dosing fluid to the inlet ports 230, 232 of the dosing manifold 110 under pressure. The first and second pump inlet ports 230, 232 are in fluid communication with a first pressure line 234. The first pressure line 234 is defined by a corresponding channel 162. In an exemplary embodiment, isolation valves 236, 238 are provided in the flow paths between the first pressure line 234 and the inlet ports 230, 232, such as proximate to the inlet ports 230, 232. The isolation valves 236, 238 define flow control devices. The isolation valves 236, 238 allow and restrict fluid flow between the first pressure line 234 and the inlet ports 230, 232, respectively. In an exemplary embodiment, the isolation valves 236, 238 are check valves. Other types of valves may be used in alternative embodiments.

In an exemplary embodiment, the dosing manifold 110 includes a pulse damper 240 in fluid communication with the first pressure line 234. The pulse damper 240 defines a flow control device. The pulse damper 240 absorbs pressure surges in the first pressure line 234. Optionally, the pulse damper 240 may be a spring dampener. Other types of pulse dampers may be used in alternative embodiments.

In an exemplary embodiment, the dosing manifold 110 includes a pressure relief valve 242 in fluid communication with the first pressure line 234. The pressure relief valve 242 is a flow control device. The pressure relief valve 242 relieves pressure in the first pressure line 234 when the pressure of the dosing fluid in the first pressure line 234 is too high. Optionally, the pressure relief valve 242 may be in fluid communication with the suction side 170 of the dosing manifold 110. For example, the pressure relief 242 may be in fluid communication with the second suction line 212. When the pressure in the first pressure line 234 is too high, the pressure relief valve 242 may open, dumping the dosing fluid into the second suction line 212 to relieve pressure in the pressure side 172. In an exemplary embodiment, the pressure relief valve 242 creates a direct flow path between the first pressure line 234 and the second suction line 212.

The dosing manifold 110 includes a second bypass line 244. The second bypass line 244 is in fluid communication with the first pressure line 234. A bypass outlet 246 is in fluid communication with the second bypass line 244. An isolation valve 248 is provided in the second bypass line 244 to allow or restrict fluid flow to the bypass outlet 246. The isolation valve 248 defines a flow control device. The second bypass line 244 and bypass outlet 246 may be used to vent the dosing manifold 110, such as during start-up of the system before the dosing fluid fills the dosing manifold 110. The second bypass line 244 and bypass outlet 246 may be used to purge or drain the dosing manifold 110 during use.

The dosing manifold 110 includes a second pressure line 250. The second pressure line 250 is fluidly connected to the first pressure line 234. In an exemplary embodiment, a back-pressure valve 252 is in fluid communication between the first and second pressure lines 234, 250. The back-pressure valve 252 defines a flow control device. The back-pressure valve 252 holds the pressure in the second pressure line 250. The second pressure line 250 defines a discharge line from which the dosing fluid is discharged from the dosing manifold 110. Optionally, when the pressure in the second pressure line 250 is too high, the back-pressure valve 252 may release some of the pressure into the first pressure line 234.

In an exemplary embodiment, the dosing manifold 110 includes a flow indicator 254. The flow indicator 254 defines a flow control device. The flow indicator 254 provides indication that flow is occurring through the dosing manifold 110. In an exemplary embodiment, the flow indicator 254 is a site flow indicator having a wheel therein that rotates when flow passes through the flow indicator 254. Rotation of the wheel is visible to provide indication that flow is occurring. In an alternative embodiment, the flow indicator 254 may be a digital flow indicator that provides a read out of the flow rate through the dosing manifold 110. Other types of flow indicators may be used in alternative embodiments.

In an exemplary embodiment, the dosing manifold 110 includes a pressure gauge 256. The pressure gauge 256 defines a flow control device. Optionally, the pressure gauge 256 may be an analog pressure gauge that uses a mechanical device to measure the pressure. Alternatively, the pressure gauge 256 may be a digital gauge that measures the pressure. The pressure gauge 256 may be electrically connected to the control system 108 to provide a reading of the pressure in the dosing manifold 110. Such information may be stored in the control system 108 and/or displayed on the display 114. The pressure gauge 256 is in fluid communication with the second pressure line 250.

The dosing manifold 110 includes a first discharge outlet port 260 and a second discharge outlet port 262. The outlet ports 260, 262 are in fluid communication with the second pressure line 250. The dosing fluid is discharged from the dosing manifold 110 through the first discharge outlet port 260 and/or the second discharge outlet port 262. Optionally, the dosing fluid may be discharged from only one of the outlet ports 260 or 262, such as whichever outlet port 260 or 262 is more convenient. Isolation valves 264, 266 are provided in the second pressure line 250 to allow or restrict fluid flow to the outlet ports 260, 262, respectively. The isolation valves 264, 266 define flow control devices. Optionally, during use, only one of the isolation valves 264 or 266 is open while the other isolation valve 264 or 266 is closed allowing discharge of the dosing fluid from the dosing manifold 110 from one of the outlet ports 260 or 262. For example, when the outlet ports 260, 262 are on opposite sides of the dosing manifold 110, the outlet port 260 or 262 that is closer to the base piping system 102 (shown in FIG. 1) may be used and connected to piping or tubing extending between the dosing manifold 110 and the base piping system 102. Having the dosing fluid discharged from only one outlet port 260, 262 ensures that all of the dosing fluid discharged from the dosing manifold 110 is discharged to the base piping system 102. In alternative embodiments, the dosing fluid may be discharged from both outlet ports 260, 262.

Figure 6:
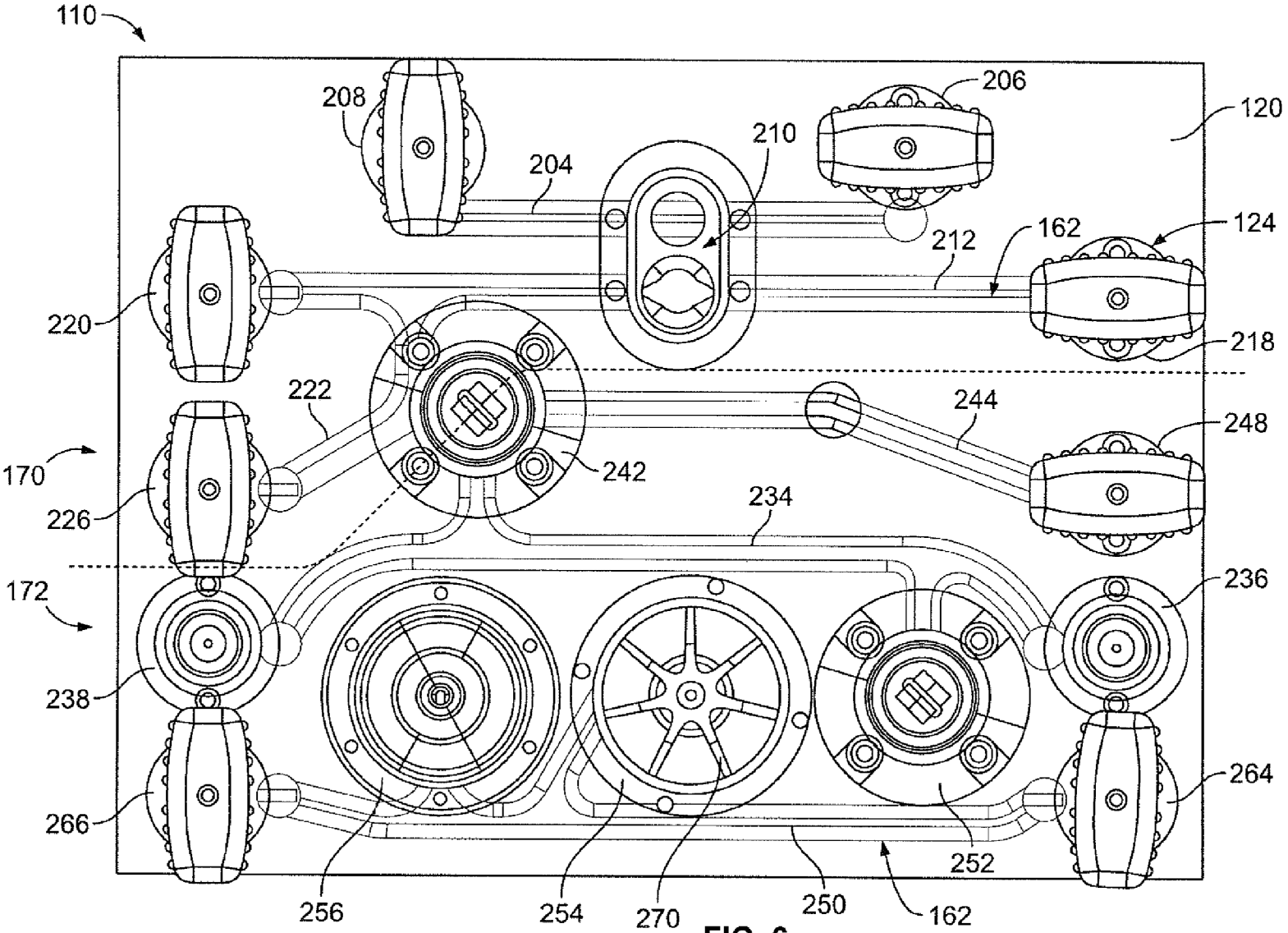
FIG. 6 is a front view of the dosing manifold.

FIG. 6 is a front view of the dosing manifold 110 in accordance with an exemplary embodiment. The front panel 120 is clear to allow a user to view the channels 162. For example, the channels 162 defining the first suction line 204, the second suction line 212, the first bypass line 222, the second bypass line 244, the first pressure line 234 and the second pressure line 250 are visible through the front panel 120. Any clogs in any of the channels 162 may be visible through the front panel 120. If a clog were to occur, portions of the dosing manifold 110 may be shut down or taken off line by closing the flow control devices 124 and/or removing the flow control devices 124 to access the channels 162 to sweep or clean the channels 162. The channels 162 may be accessed by removing the piping or tubing connected to the inlet or outlet ports 126, 128 or by removing the flow control devices 124.

Exemplary embodiments of the flow control devices 124 are illustrated in FIG. 6. The isolation valves 206, 208, 218, 220, 226, 248, 264 and 266 are represented by quarter-turn ball valves, however other types of valves may be used in alternative embodiments, such as solenoid valves, pneumatic valves or other types of valves. The isolation valves may be manually actuated or may be electrically actuated.

In the illustrated embodiment, the isolation valves 236, 238 are represented by check valves, however other types of valves may be used in alternative embodiments. The check valves allow one way flow therethrough, in this case, fluid flow into the dosing manifold 110, such as from the dosing pumps 112 (shown in FIG. 1). The check valves do not allow flow in the opposite direction or out of the dosing manifold 110 to the dosing pumps 112. Other types of valves may be used in alternative embodiments.

An exemplary embodiment of the strainer 210 is illustrated in FIG. 6. The strainer 210 straddles the first suction line 204 and the second suction line 212 to create a flow path between the first suction line 204 and the second suction line 212. A filter is received in the strainer 210 through which the fluid passes from the first suction line 204 to the second suction line 212. Other types of strainers 210 may be used in alternative embodiments to strain the dosing fluid in the suction side 170 of the dosing manifold 110. Straining the dosing fluid in the suction side 170 allows contaminates in the dosing fluid to be removed prior to the dosing fluid being transferred to the dosing pumps 112.

The pressure relief valve 242 illustrated in FIG. 6 straddles the first pressure line 234 and the second suction line 212 or the bypass line 222. The pressure relief valve 242 creates a flow path between the first pressure line 234 and the second suction line 212. In an exemplary embodiment, the pressure relief valve 242 includes a diaphragm that may be spring loaded and normally closed to restrict flow between the pressure side 172 and the suction side 170. When the pressure in the pressure side 172 exceeds a threshold pressure, the pressure relief valve 242 may open allowing the dosing fluid to dump into the suction side 170.

In an exemplary embodiment, the back-pressure valve 252 is a similar type of valve as the pressure relief valve 242. The back-pressure valve 252 includes a diaphragm that is normally closed to close the fluid path between the first pressure line 234 and the second pressure line 250. The back-pressure valve 252 holds the pressure in the second pressure line 250. When the dosing pumps 112 pump dosing fluid into the first pressure line 234, the pressure in the first pressure line 234 exceeds the threshold pressure of the back-pressure valve 252 opening the diaphragm and causing the dosing fluid to flow from the first pressure line 234 into the second pressure line 250. The back-pressure valve 252 may then close holding the pressure in the second pressure line 250 until the next surge from the dosing pumps 112. Other types of back-pressure valves 252 may be used in alternative embodiments. In other alternative embodiments, no back-pressure valve may be used, but rather the first and second pressure lines 234, 250 may be open to one another allowing free flow of fluid therebetween.

In the illustrated embodiment, the flow indicator 254 includes a wheel 270 that spins as dosing fluid flows through the flow indicator 254. The exterior of the flow indicator 254 is clear allowing the wheel 270 to be visible. Rotation of the wheel 270 indicates flow through the dosing manifold 110. Other types of flow indicators 254 may be used in alternative embodiments, including digital flow indicators which provide a digital readout of a flow rate through the dosing manifold 110.

The pressure gauge 256 may be an analog pressure gauge having a needle to indicate the pressure in the second pressure line 250. Other types of pressure gauges 256 may be used in alternative embodiments, including digital pressure gauges that have a readout or display of the pressure in the second pressure line 250 on the pressure gauge 256 itself or alternatively, the pressure gauge 256 may be connected to the control system 108 (shown in FIG. 1) to provide a reading of the pressure at the display 114.

Figure 7:
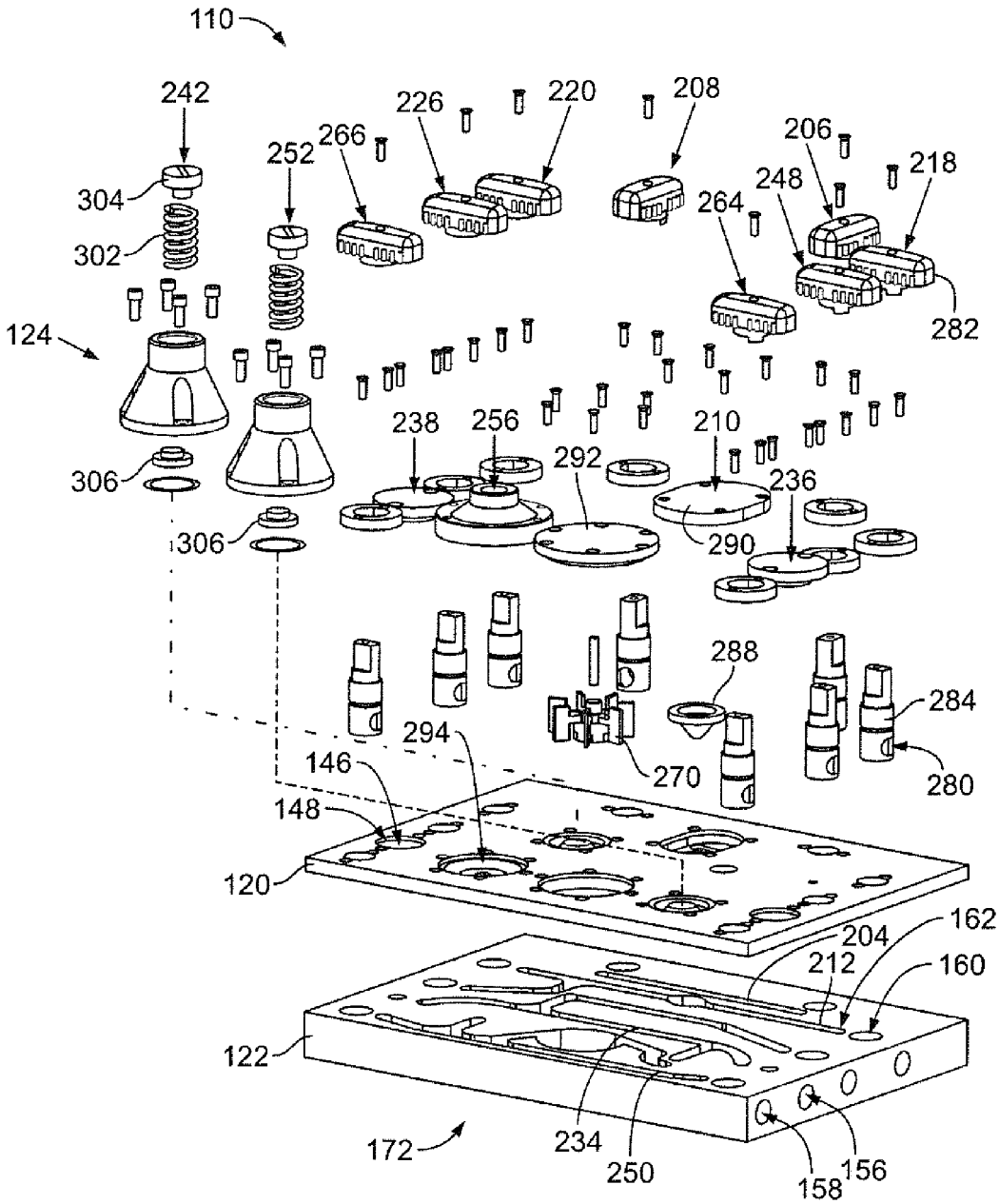
FIG. 7 is an exploded view of the dosing manifold showing exemplary flow control devices.

FIG. 7 is an exploded view of the dosing manifold 110 showing the rear panel 122 exploded from the front panel 120 and showing the flow control devices 124 exploded from the front panel 120. The flow control devices 124 are configured to be received in the openings 146 in the front panel 120 and secured to the front panel 120, such as using fasteners or other securing means. The front panel 120 holds all of the flow control devices 124. Optionally, the flow control devices 124 may be coupled to the front panel 120 prior to the front panel 120 being coupled to the rear panel 122. Alternatively, the front panel 120 may be coupled to the rear panel 122 prior to the flow control devices 124 being coupled to the front panel 120. The openings 146 and device seats 148 are sized and shaped to receive corresponding flow control devices 124.

In an exemplary embodiment, portions of the flow control devices 124 may extend through the front panel 120 and into the rear panel 122. For example, the isolation valves 206, 208, 218, 220, 226, 248, 264 and 266 may be received in corresponding openings 160 and the rear panel 122. Such isolation valves include openings 280 therethrough, that when aligned with the inlet or outlet ports, 156, 158 and corresponding channels 162 in the rear panel 122 allow flow through the flow paths of the rear panel 122. When the openings 280 are turned such that the openings 280 are not in fluid communication with the ports 156 or 158 and the channels 162, fluid flow therethrough is restricted. Such isolation valves include handles 282 configured to be coupled to valve stems 284 of the isolation valves that have the openings 280 to manually turn the valve stems 284 between open and closed positions. The front panel 120 and the rear panel 122 define the valve bodies of the isolation valves by providing the structure that surrounds the valve stems 284. Separate fittings or connections do not need to be made, but rather the flow paths are defined by the rear panel 122 and/or front panel 120.

The strainer 210 includes a filter 288 and a cover piece 290 that covers the corresponding opening 146 and the front panel 120. The front panel 120 includes two openings that extend entirely therethrough that are aligned with the first suction line 204 and the second suction line 212 to create a flow path through the front panel 120. The front panel 120 defines part of the flow path for the dosing fluid. The filter 288 is received in the front panel 120 and the cover piece 290 covers the corresponding opening 146 and filter 288. The cover piece 290 defines part of the flow path for the dosing fluid through the dosing manifold 110. The cover piece 290 is secured to the front panel 120 by fasteners, however other securing means may be used in alternative embodiments.

The isolation valves 236, 238, which are check valves in the illustrated embodiment, are configured to be coupled to the front panel 120. The front panel 120 may define part of the flow path for the dosing fluid through the check valves.

The wheel 270 is illustrated in FIG. 7. A cover piece 292 is configured to be secured to the front panel 120 over the wheel 270. The cover piece 290 may be clear to allow the wheel 270 to be visible through the cover piece 292.

The pressure gauge 256 is configured to be coupled to the front panel 120 using fasteners, however other securing means may be used in alternative embodiments. Optionally, the dosing fluid may flow into the front panel 120 into the space below the pressure gauge 256. The pressure gauge 256 may include a diaphragm or board to measure the pressure of the fluid in a cavity 294 defined by the front panel 120.

The pressure relief valve 242, in the illustrated embodiment, includes a diaphragm 300 and a spring 302 that presses against the diaphragm 300 to control the pressure threshold at which the pressure relief valve 242 is released. The tension on the spring 302 may be altered or controlled by rotating a knob 304 to either increase or decrease the spring force on the diaphragm 300. The pressure relief valve 242 is secured to the front panel 120 by fasteners, however other types of securing means may be used in alternative embodiments. Optionally, when the diaphragm 300 is released and the pressure relief valve 242 is opened, a portion of the dosing fluid may flow into the front panel 120 and through a corresponding drain that drains into the second suction line 212.

In the illustrated embodiment, the back-pressure valve 252 is similar to the pressure relief valve 242 and operates in a similar manner. The back-pressure valve 252 includes a diaphragm 306 that allows and restricts flow between the first pressure line 234 and the second pressure line 250 defined by corresponding channels 162 and the rear panel 122. The diaphragm 306 may be released at a pressure threshold that is lower than a pressure threshold of the diaphragm 300 to ensure that the back-pressure valve 252 is able to open during normal use while the pressure relief valve 242 remains closed during normal use, until the pressure in the pressure side 172 gets too high, at which time the pressure relief valve 242 will open.

Figure 8:
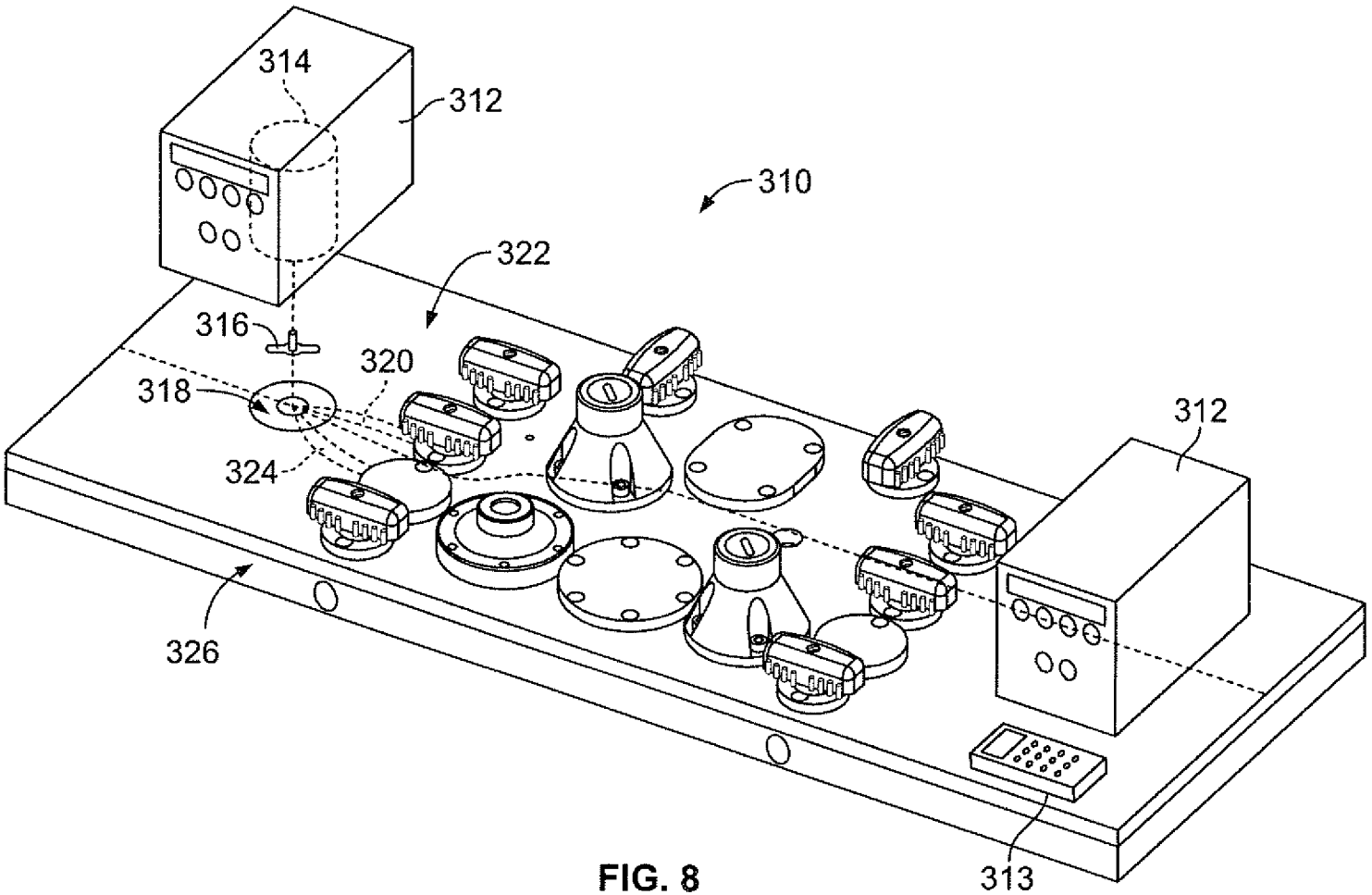
FIG. 8 illustrates a dosing manifold in accordance with an alternative embodiment.

FIG. 8 illustrates an alternative dosing manifold 310 formed in accordance with an alternative embodiment. The dosing manifold 310 is similar to the dosing manifold 110. However, dosing pumps 312 are configured to be mounted directly to the dosing manifold 310. A controller 313 is mounted to the dosing manifold 310. The dosing manifold 310 supports some or all of the components of the dosing system without the need for a skid. The dosing manifold 310 may be wall mounted. The dosing manifold 310 may be oriented horizontally or vertically.

The dosing pumps 312 each include a motor 314 that drives the pressure of the pump 312. The dosing manifold 310 includes an opening defining a volute 318 that receives a portion of the pump 312 or a pipe from the pump 312. A supply channel 320 is in fluid communication with the volute 318 and supplies dosing fluid from a suction side 322 of the dosing manifold 310. A discharge channel 324 is in fluid communication with the volute 318 and a pressure side 326 of the dosing manifold 310. In an exemplary embodiment, the supply channel 322 discharges the dosing fluid directly into the volute 318, without intervening piping or fittings, and the discharge channel 324 receives the dosing fluid directly from the volute 318, without intervening piping or fittings. The dosing manifold 310 may operate in a similar manner as the dosing manifold 110, however the dosing pumps 312 are an integral part of the dosing manifold 310.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A dosing system for delivering a dosing fluid, the dosing system comprising:

a dosing manifold having a front panel and a rear panel coupled together, the rear panel having an inner wall and an outer wall opposite the inner wall, the rear panel having a plurality of channels open at the inner wall, and the rear panel having a plurality of exterior inlet and outlet ports, the inlet and outlet ports being in fluid communication with corresponding channels, the channels being configured to receive the dosing fluid through corresponding inlet ports, the channels being configured to deliver the dosing fluid to corresponding outlet ports, the front panel holding a plurality of flow control devices, the flow control devices being in fluid communication with corresponding channels to control the flow of the dosing fluid in the channels, the front panel having an inner wall and an outer wall opposite the inner wall, the inner wall of the front panel faces the inner wall of the rear panel with the outer wall of the front panel facing in an opposite direction as the outer wall of the rear panel, the inner wall of the front panel defines portions of the channels; and a dosing pump in fluid communication with the dosing manifold, the dosing pump being configured to pump the dosing fluid through the dosing manifold.

2. The dosing system of claim 1, wherein the front panel includes a plurality of openings extending through the front wall that open to corresponding channels, the openings receiving corresponding flow control devices, portions of the front wall adjacent the openings covering the associated channels to define portions of the channels.

3. The dosing system of claim 1, wherein at least some of the front panel is clear to allow portions of one or more of the channels to be visible through the front panel.

4. The dosing system of claim 1, wherein the front panel and the rear panel are manufactured from a plastic material.

5. The dosing system of claim 1, wherein at least some of the flow control devices extend into the channels.

6. The dosing system of claim 1, wherein the front panel is sealed to the rear panel to seal the channels.

7. The dosing system of claim 1, wherein the inlet and outlet ports comprise standard piping connections configured to be attached to pipes of a piping system.

8. The dosing system of claim 1, wherein the dosing pump is connected to at least one outlet port and at least one inlet port.

9. The dosing system of claim 1, wherein the dosing pump is mounted to the dosing manifold.

10. The dosing system of claim 1, wherein the dosing manifold includes a suction side and a pressure side, the suction includes at least one of the inlet ports, at least one of the outlet ports and at least one channel, the pressure side includes at least one of the inlet ports, at least one of the outlet ports, and at least one channel, the dosing pump is connected between the outlet port of the suction side and the inlet port of the pressure side.

11. The dosing system of claim 1, wherein the dosing manifold includes a suction side and a pressure side, the suction side includes at least one of the inlet ports, at least one of the outlet ports and at least one channel, the pressure side includes at least one of the inlet ports, at least one of the outlet ports, and at least one channel, the flow control devices comprise a pressure relief valve connecting a corresponding channel of the pressure side with a corresponding channel of the suction side.

12. The dosing system of claim 1, wherein the dosing manifold includes a suction side and a pressure side, the suction includes at least one of the inlet ports, at least one of the outlet ports and at least one channel, the pressure side includes at least one of the inlet ports, at least one of the outlet ports, and at least one channel, the flow control devices comprise a strainer in a corresponding channel of the suction side.

13. The dosing system of claim 1, wherein the dosing manifold includes a suction side and a pressure side, the suction includes at least one of the inlet ports, at least one of the outlet ports and at least one channel, the pressure side includes at least one of the inlet ports, at least one of the outlet ports, and at least one channel, the flow control devices comprise a pressure gauge measuring a pressure of the dosing fluid in the pressure side.

14. The dosing system of claim 1, wherein the dosing manifold includes a suction side and a pressure side, the suction side includes at least one of the inlet ports, at least one of the outlet ports and at least one channel, the pressure side includes at least one of the inlet ports, at least one of the outlet ports, and at least one channel, the flow control devices comprise a flow indicator in the pressure side.

15. The dosing system of claim 1, wherein the flow control devices comprise isolation valves mounted proximate to corresponding inlet or outlet ports, the isolation valves allow or restrict flow between the channel and the corresponding inlet or outlet port.

16. The dosing system of claim 1, wherein the front and rear panels are planar with the front panel forward of the rear panel and with the rear panel rearward of the front panel.

17. The dosing system of claim 1, wherein at least one of the front panel and the rear panel having an opening defining a volute in fluid communication with at least one channel;

wherein the dosing pump is coupled to the volute such that at least a portion of the pump is received in the volute.

18. The dosing system of claim 17, wherein the channels in the rear panel include a supply channel discharging directly into the volute and a discharge channel receiving the dosing fluid directly from the volute.

19. The dosing system of claim 17, wherein the front panel is sealed to the rear panel to seal the channels.

20. The dosing system of claim 17, wherein at least some of the front panel is clear to allow portions of one or more of the channels to be visible through the front panel.

21. The dosing system of claim 17, wherein at least some of the flow control devices extend into the channels.

22. The dosing system of claim 17 wherein the rear panel includes a suction side and a pressure side, the suction side includes at least one of the inlet ports, at least one of the outlet ports and at least one channel, the pressure side includes at least one of the inlet ports, at least one of the outlet ports, and at least one channel, the dosing pump is connected between the outlet port of the suction side and the inlet port of the pressure side.

23. A dosing manifold for delivering a dosing fluid, the dosing manifold comprising:

a rear panel being planar and having an inner wall, an outer wall and side walls between the inner and outer walls, the rear panel having a plurality of channels open along at least portions thereof at the inner wall, and the rear panel having a plurality of exterior inlet and outlet ports at the side walls, the inlet and outlet ports being in fluid communication with corresponding channels, the channels being configured to receive the dosing fluid through corresponding inlet ports, the channels being configured to deliver the dosing fluid to corresponding outlet ports; and a front panel being planar and attached to and extending along the inner wall of the rear panel, the front panel holding a plurality of flow control devices, the flow control devices being in fluid communication with corresponding channels to control the flow of the dosing fluid in the channels.

24. The dosing manifold of claim 23, wherein the front panel includes an inner wall and an outer wall opposite the inner wall, the rear panel includes an inner wall and an outer wall opposite the inner wall, the inner wall of the front panel faces the inner wall of the rear panel, the inner wall of the front panel defines portions of the channels and the front panel is sealed to the rear panel to seal the channels.

25. The dosing manifold of claim 23, wherein at least some of the front panel is clear to allow portions of one or more of the channels to be visible through the front panel.

26. The dosing manifold of claim 23, wherein at least some of the flow control devices extend into the channels.

27. The dosing manifold of claim 23, wherein the rear panel includes a suction side and a pressure side, the suction side includes at least one of the inlet ports, at least one of the outlet ports and at least one channel, the pressure side includes at least one of the inlet ports, at least one of the outlet ports, and at least one channel, the flow control devices comprise a pressure relief valve connecting a corresponding channel of the pressure side with a corresponding channel of the suction side.

28. The dosing manifold of claim 23, wherein the rear panel includes a suction side and a pressure side, the suction side includes at least one of the inlet ports, at least one of the outlet ports and at least one channel, the pressure side includes at least one of the inlet ports, at least one of the outlet ports, and at least one channel, the flow control devices comprise a strainer in a corresponding channel of the suction side.

29. The dosing manifold of claim 23, wherein the rear panel includes a suction side and a pressure side, the suction side includes at least one of the inlet ports, at least one of the outlet ports and at least one channel, the pressure side includes at least one of the inlet ports, at least one of the outlet ports, and at least one channel, the flow control devices comprise a pressure gauge measuring a pressure of the dosing fluid in the pressure side.

30. The dosing manifold of claim 23, wherein the rear panel includes a suction side and a pressure side, the suction side includes at least one of the inlet ports, at least one of the outlet ports and at least one channel, the pressure side includes at least one of the inlet ports, at least one of the outlet ports, and at least one channel, the flow control devices comprise a flow indicator in the pressure side.

31. The dosing manifold of claim 23, wherein the flow control devices comprise isolation valves mounted proximate to corresponding inlet or outlet ports, the isolation valves allow or restrict flow between the channel and the corresponding inlet or outlet port.

* * * * *